US006948335B2

(12) United States Patent
Matsuoka

(10) Patent No.: US 6,948,335 B2
(45) Date of Patent: Sep. 27, 2005

(54) COMPRESSION MECHANISM FOR REFRIGERATION SYSTEM

(75) Inventor: Hiromune Matsuoka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/485,063

(22) PCT Filed: May 22, 2003

(86) PCT No.: PCT/JP03/06437

§ 371 (c)(1),
(2), (4) Date: Jan. 28, 2004

(87) PCT Pub. No.: WO03/100328

PCT Pub. Date: Dec. 4, 2003

(65) Prior Publication Data

US 2005/0066684 A1 Mar. 31, 2005

(30) Foreign Application Priority Data

May 28, 2002 (JP) ..... 2002-154157

(51) Int. Cl.[7] ..... F25B 43/02

(52) U.S. Cl. ..... 62/470; 62/335; 62/503; 62/510; 62/512; 62/513

(58) Field of Search ..... 62/335, 470, 503, 62/510, 512, 513

(56) References Cited

U.S. PATENT DOCUMENTS 4,788,829 A * 12/1988 Takemasa et al. ..... 62/335

5,265,443 A * 11/1993 Yuzawa et al. ..... 62/498

FOREIGN PATENT DOCUMENTS

| | | |
|---|---|---|
| JP | 11-6657 | 1/1999 |
| JP | 2001-324231 | 11/2001 |
| JP | 2001-329958 | 11/2001 |

* cited by examiner

*Primary Examiner*—Melvin Jones
(74) *Attorney, Agent, or Firm*—Shinjyu Global IP Counselors, LLP

(57) ABSTRACT

The present invention provides an oil equalizing circuit for a refrigeration system provided with a plurality of compression mechanisms, the oil equalizing circuit being capable of supplying sufficient oil to the compressors that are running during partial load operation. The refrigeration system compression mechanism is provided with the following: first, second, and third compressors; a refrigerant intake main pipe; first, second, and third intake branch pipes connected to the intake sides of the compressors; first, second, and third oil separators connected to the discharge sides of the compressors; and first, second, and third oil return pipes provided on the oil separators. The first oil return pipe is configured such that oil is delivered to the refrigerant intake main pipe due to gravity when only the first compressor is running. The second oil return pipe is configured such that oil is delivered to the refrigerant intake main pipe due to gravity when only the first and second compressors are running.

4 Claims, 5 Drawing Sheets

COMPRESSION MECHANISM FOR REFRIGERATION SYSTEM

TECHNICAL FIELD

The present invention relates to a compression mechanism for refrigeration systems and, more particularly, to a compression mechanism constituting a refrigerant circuit of a vapor compression refrigeration system.

BACKGROUND ART

One example of conventional vapor compression refrigeration systems provided with a compression mechanism having a plurality of compressors are air conditioning systems used to air-condition buildings. This kind of air conditioning system is provided with a plurality of user units and a heat source unit with a large capacity that is sufficient for accommodating the heating and cooling loads of the user units. In order to enable the system to be operated in a partial load mode, the heat source unit is provided with a compression mechanism made up of a plurality of comparatively small-capacity compressors connected in parallel. The compression mechanism is provided with an oil equalizing circuit including an oil separator connected to the discharge sides of the compressors, oil return pipes for returning the oil separated by the oil separator to the compressors, and oil equalizing pipes connected between the compressors for reducing imbalances in the amount of oil in the compressors.

In the conventional compression mechanism just described, the oil equalizing circuit around the compressors becomes complex because it includes a return pipe for each compressor and a plurality of equalizing pipes connected between the compressors. The larger the number of compressors, the more complex the oil equalizing circuit becomes.

In a system whose compression mechanism has three or more compressors, a plurality of combinations of running compressors and stopped compressors occur when the system is operated in partial load mode and it is difficult to supply sufficient oil to the running compressors during all of the operating combinations.

DISCLOSURE OF THE INVENTION

The object of the present invention is to provide a compression mechanism having an oil equalizing circuit that can supply sufficient oil to the compressors that are running—even during partial load operation.

In a first aspect of the present invention, a refrigeration system compression mechanism is a compression mechanism forming a refrigerant circuit of a vapor compression refrigeration system and is provided with the following: a refrigerant intake main pipe; n compressors, i.e., first to nth compressors (where n is any integer equal to or greater than 3); n oil separators; and n oil return pipes. The n compressors are arranged such that the second to nth compressors are connected to the refrigerant intake main pipe in sequence from the upstream side of the flow of intake gaseous refrigerant and the first compressor is connected downstream of the nth compressor. The n separators are connected to the discharge sides of the respective first to nth compressors in order to separate the oil from the gaseous refrigerant compressed by the first to nth compressors. The n oil return pipes are arranged such that the first to n−1 oil return pipes are connected between the oil outlets of the first to n−1 oil separators and the intake sides of the respective second to nth compressors and the nth oil return pipe is connected between the nth oil separator and the intake side of the first compressor. The first to kth oil return pipes (where k is integers from 2 to n−1) are connected to the intake side of the k+1 compressor so that oil is delivered to the first compressor when the first to k compressors are running and the k+1 to nth compressors are stopped.

In this refrigeration system compression mechanism, the oil flow is configured such that when all of the first to n compressors are running, the oil discharged with the gaseous refrigerant from the first compressor is separated by the first oil separator and delivered to the second compressor through the first oil return pipe, the oil discharged from the second compressor is delivered to the third compressor through the second oil return pipe, and so on to the nth compressor, the oil discharged from the nth compressor being delivered to the first compressor through the nth oil return pipe. Thus, this compression mechanism forms an oil circulation cycle in which the oil passes through each compressor in turn and is reliably delivered to all of the compressors that are running, i.e., the first to nth compressors.

Furthermore, the oil flow of this refrigeration system compression mechanism is configured such that when the first to kth compressors are running and the k+1 to nth compressors are not running, the oil delivered from the kth oil return pipe to the intake side of the k+1 compressor is fed to the refrigerant intake main pipe and drawn together with gaseous refrigerant into the first compressor, which is connected farther downstream than the k+1 compressor. Since the kth compressor is connected to the refrigerant intake main pipe at a more upstream position than the k+1 compressor, an oil circulation cycle is achieved in which the oil returned through the kth oil return pipe is not drawn again into the second to kth compressors (i.e., running compressors other than the first compressor) but rather passes through each of the running compressors in turn in the same manner as when all of the first to nth compressors are running. As a result, oil is reliably delivered to the compressors that are running, i.e., the first to kth compressors.

Thus, with this compression mechanism, oil can be delivered reliably to the compressors that are running even when the system is operated in partial load mode.

In a second aspect of the present invention, a refrigeration system compression mechanism is a refrigeration compression mechanism in accordance with the first aspect, provided with n intake branch pipes, i.e., first to nth intake branch pipes, that branch from the refrigerant intake main pipe in such a manner as to correspond to the intake sides of the first to nth compressors, respectively. The first to n−1 oil return pipes are connected to the second to nth intake branch pipes, respectively. The second to nth intake branch pipes are arranged so as to slope downward from the part where they connect to the first to n−1 oil return pipes, respectively, toward the part where they connect to the refrigerant intake main pipe.

In this refrigeration system compression mechanism, a structure for sending oil to the refrigerant intake main pipe from the first to n−1 oil return pipes corresponding to compressors that are not running is obtained by making the second to nth intake branch pipes slope downward from the parts where they connect to the first to n−1 oil return pipes toward the parts where they connect to the refrigerant intake main pipe. As a result, the structure of the circuit from the refrigerant intake main pipe to the intake sides of the compressors is not complex.

In a third aspect of the present invention, a refrigeration system compression mechanism is a refrigeration compression mechanism in accordance with the second aspect, wherein the refrigerant intake main pipe slopes downward from the part where it connects to the second to nth intake branch pipes toward the part where it connects to the first intake branch pipe.

With this refrigeration system compression mechanism, the oil is reliably drawn into the first compressor because the oil delivered to the refrigerant intake main pipe from the second to n intake branch pipes flows readily toward the part where the refrigerant intake main pipe connects to the first intake branch pipe. Thus, the reliability of the oil supply to the compressors is improved.

In a fourth aspect of the present invention, a refrigeration system compression mechanism is a compression mechanism forming a refrigerant circuit of a vapor compression refrigeration system and is provided with the following: a refrigerant intake main pipe; first, second, and third compressors; first, second, and third oil separators; and first second and third oil return pipes. The second and third compressors are connected in sequence from the upstream side of the flow of intake gaseous refrigerant. The first compressor is connected to the refrigerant intake main pipe at a position downstream of the third compressor. The first, second, and third oil separators are connected to the discharge sides of the first, second, and third compressors, respectively, in order to separate the oil from the gaseous refrigerant compressed by the first, second, and third compressors. The first and second oil return pipes are connected from the oil outlets of the first and second oil separators to the intake sides of the second and third compressors, respectively. The third oil return pipe is connected from the third oil separator to the intake side of the first compressor. The first oil return pipe is connected to the intake side of the second compressor so that oil is delivered to the refrigerant intake main pipe when the first compressor is running and the second and third compressors are stopped. The second oil return pipe is connected to the intake side of the third compressor so that oil is delivered to the refrigerant intake main pipe when the first and second compressors are running and the third compressor is stopped.

In this refrigeration system compression mechanism, the oil flow is configured such that when the first, second, and third compressors are all running, the oil discharged with the gaseous refrigerant from the first compressor is separated by the first oil separator and delivered to the second compressor through the first oil return pipe, the oil discharged from the second compressor is delivered to the third compressor through the second oil return pipe, and the oil discharged from the third compressor is delivered to the first compressor through the third oil return pipe. Thus, this compression mechanism forms a circulation cycle in which the oil passes through each compressor in turn and is reliably delivered to the compressors that are running, i.e., the first, second, and third compressors.

Furthermore, the oil flow of this refrigeration system compression mechanism is configured such that when the first compressor is running and the second and third compressors are not running, the oil delivered from the first oil return pipe to the intake side of the second compressor is fed to the refrigerant intake main pipe and drawn together with gaseous refrigerant into the first compressor, which is connected farther downstream than the second compressor. As a result, oil is reliably delivered to the compressor that is running, i.e., the first compressor.

Moreover, the oil flow of this refrigeration system compression mechanism is configured such that when the first and second compressors are running and the third compressor is not running, the oil delivered from the second oil return pipe to the intake side of the third compressor is fed to the refrigerant intake main pipe and drawn together with gaseous refrigerant into the first compressor through the first intake branch pipe, which is connected farther downstream than the third compressor. Since the second compressor is connected to the refrigerant intake main pipe at a more upstream position than the third compressor, an oil circulation cycle is achieved in which the oil returned through the second oil return pipe is not drawn again into the second compressor but rather passes through each of the compressors in turn in the same manner as when the first, second, and third compressors are all running. As a result, oil is reliably delivered to the compressors that are running, i.e., the first and second compressors.

Thus, with this refrigeration system compression mechanism, oil can be delivered reliably to the compressors that are running even when the system is operated in partial load mode with only the first compressor running or only the first and second compressors running.

BRIEF DESCRIPTIONS OF THE DRAWINGS

PREFERRED EMBODIMENTS OF THE INVENTION

[First Embodiment]

(1) Constituent Features of the Refrigeration System Compression Mechanism

Figure 1:
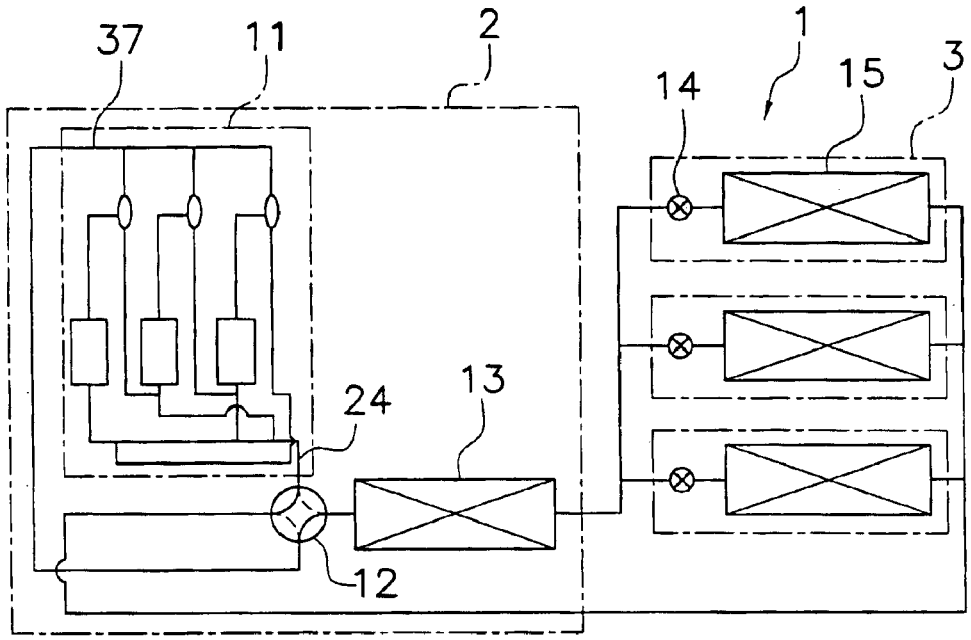
FIG. 1 is a schematic view of the refrigerant circuit of an air conditioning system in accordance with the present invention.

One example of a vapor compression refrigeration system provided with a compression mechanism having a plurality of compressors is a air conditioning system 1 provided with a refrigerant circuit like that shown in FIG. 1. The air conditioning system 1 is provided with one heat source unit 2 and a plurality of user units 3 connected in parallel thereto. It is used, for example, to air-condition an office building or the like. The heat source unit 2 is equipped chiefly with a compression mechanism 11, a four-way selector valve 12, and heat-source-side heat exchanger 13. In this embodiment, air or water serving as a heat source is supplied to the heat-source-side heat exchanger 13 and the heat-source-side heat exchanger 13 serves to exchange heat between the heat source and the refrigerant. The user units 3 are each equipped with an expansion valve 14 and a user side heat exchanger 15. These devices 11, 12, 13, 14, 15 are connected together in sequence by refrigerant piping to form the refrigerant circuit of the air conditioning system 1.

Figure 2:
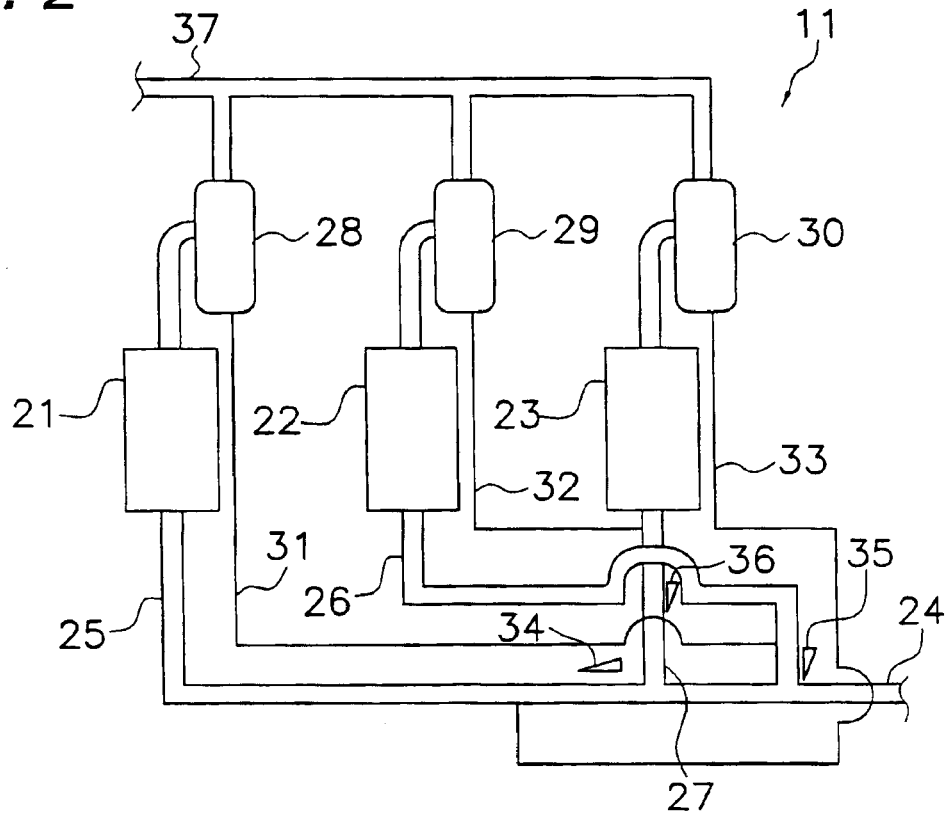
FIG. 2 is an enlarged partial view of FIG. 1 showing a compression mechanism in accordance with a first embodiment.

The compression mechanism 11 serves to compress the gaseous refrigerant that returns to the heat source unit 2 after passing through the user-side heat exchangers 15 of the user units 3. As shown in FIG. 2, the compression mechanism 11 is provided with the following: first, second, and third compressors 21, 22, 23; a refrigerant intake main pipe 24; first, second, and third intake branch pipes 25, 26, 27; first, second, and third oil separators 28, 29, 30; and first, second, and third oil return pipes 31, 32, 33. The refrigerant intake main pipe 24 is connected to the outlet of the four-way selector valve 12, as shown in FIG. 1. The refrigerant pipes at the outlets of the first, second, and third oil separators 28, 29, 30 merge with the discharge merge pipe 37. The discharge merge pipe 37 connects to the inlet of the four-way selector valve 12.

The second intake branch pipe 26 branches from the refrigerant intake main pipe 24 and is connected such that it corresponds to the intake side of the second compressor 22. The third intake branch pipe 27 branches from the refrigerant intake main pipe 24 at a position downstream of the second intake branch pipe 26 and is connected such that it corresponds to the intake side of the third compressor 23. The first intake branch pipe 25 branches from the refrigerant intake main pipe 24 at a position downstream of the third intake branch pipe 27 and is connected such that it corresponds to the intake side of the first compressor 21. The refrigerant intake main pipe 24 is arranged such that it slopes downward from the part where it connects to the second and third intake branch pipes 26, 27 toward the part where it connects to the first intake branch pipe 25 (see the wedge symbol 34 in FIG. 2).

The first, second, and third separators 28, 29, 30 are connected to the discharge sides of the respective first, second, and third compressors 21, 22, 23 in order to separate the oil from the gaseous refrigerant compressed by the first, second, and third compressors 21, 22, 23.

The first and second oil return pipes 31, 32 connect from the oil outlets of the first and second oil separators 28, 29 to the intake sides of the second and third compressors 22, 23, respectively. The third oil return pipe 33 is connected from the third oil separator 30 to the intake side of the first compressor 21. More specifically, the first and second oil return pipes 31, 32 are connected to the second and third intake branch pipes 26, 27, respectively, and the third oil return pipe 33 is connected to the refrigerant intake main pipe 24 at a position downstream of the second intake branch pipe 26.

The first oil return pipe 31 is connected to the intake side of the second compressor 22 such that oil is delivered to the refrigerant intake main pipe 24 by gravity when the first compressor 21 is running and the second and third compressors 22, 23 are stopped. The second oil return pipe 32 is connected to the intake side of the third compressor 23 such that oil is delivered to the refrigerant intake main pipe 24 by gravity when the first and second compressors 21, 22 are running and the third compressor 23 is stopped. More specifically, the second and third intake branch pipes 26, 27 are arranged such that they slope downward from the part where they connect to the first and second oil return pipes 31, 32, respectively, toward the part where they connect to the refrigerant intake main pipe 24 (see the wedge symbols 35 and 36 in FIG. 2).

(2) Operation of the Compression Mechanism

Figure 3:
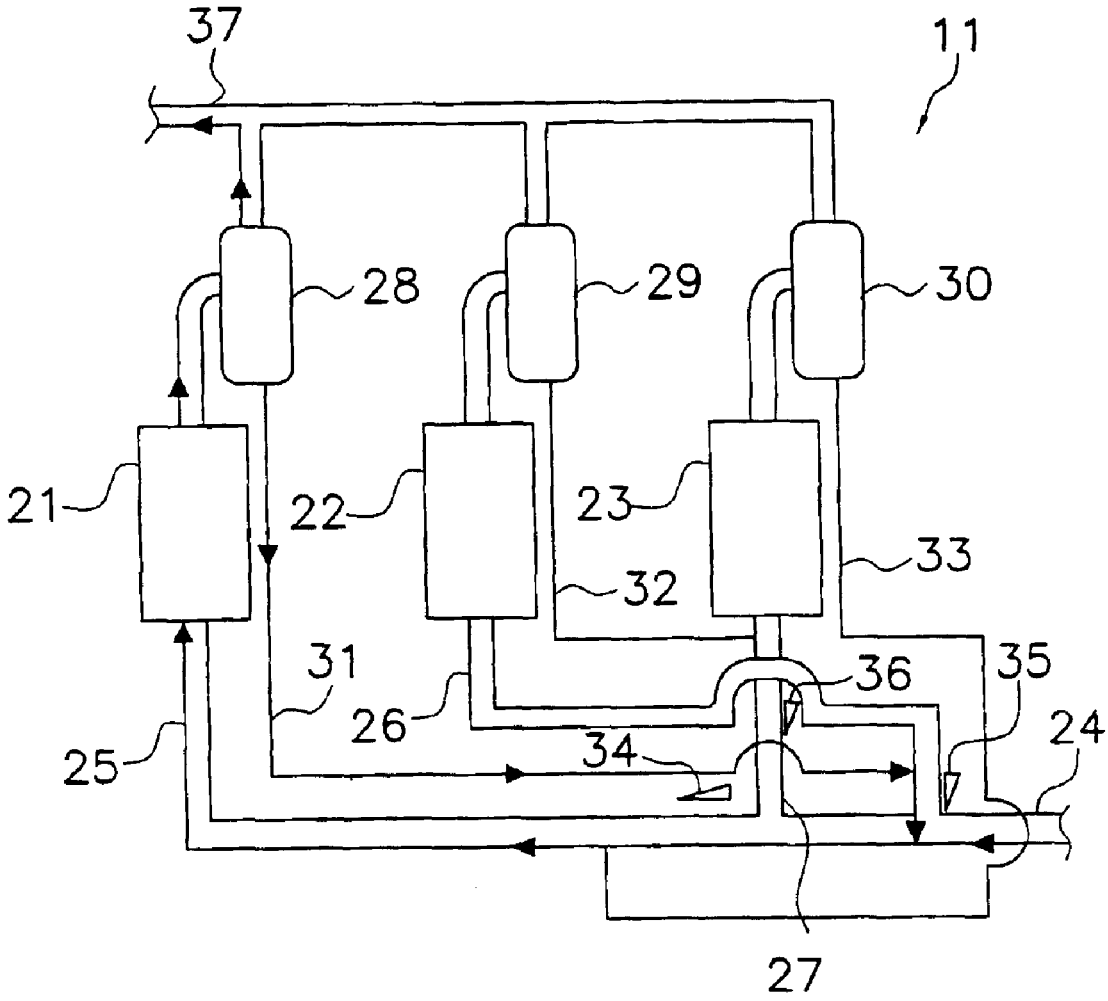
FIG. 3 illustrates the operation of a compression mechanism in accordance with the first embodiment.

The operation of a compression mechanism 11 in accordance with this embodiment will now be described using FIGS. 3 to 5.

[1] Partial Load Operation (First Compressor Running)

When the compression mechanism 11 is started, first the first compressor 21 is started. Then, as shown in FIG. 3 (the flow of refrigerant and oil is indicated in FIG. 3 with arrows), gaseous refrigerant along with oil is drawn into the first compressor 21 from the refrigerant intake main pipe 24 through the first intake branch pipe 25. The gaseous refrigerant drawn into the first compressor 21 is then compressed and discharged, after which it flows into the first oil separator 28. Since the gaseous refrigerant discharged from the first compressor 21 contains excess oil, the excess oil is separated from the gaseous refrigerant by vapor-liquid separation in the first oil separator 28. Then, the gaseous refrigerant passes through the refrigerant pipe at the outlet of the first oil separator 28, flows into the discharge merge pipe 37, and circulates through the refrigerant circuit shown in FIG. 1.

Meanwhile, the oil separated in the first oil separator 28 leaves the oil outlet of the first oil separator 28, passes through the first oil return pipe 31 and flows into the second intake branch pipe 26. The second intake branch pipe 26 is arranged so as to slope downward from the part where it connects to the first oil return pipe 31 toward the part where it connects to the refrigerant intake main pipe 24 (see the wedge symbol 35 in FIG. 3). As a result, the oil that flows into the second intake branch pipe 26 from the first oil return pipe 31 descends through the second intake branch pipe 26 due to the action of gravity and is delivered to the refrigerant intake main pipe 24. The oil that flows into the refrigerant intake main pipe 24 is drawn into the first compressor 21 again along with the gaseous refrigerant flowing through the refrigerant intake main pipe 24. Since the refrigerant intake main pipe 24 slopes downward toward the first intake branch pipe 25 (see wedge symbol 34), the oil flowing into the refrigerant intake main pipe 24 flows readily toward the first intake branch pipe 25. In this way, an oil supply circuit is formed in which oil is supplied to the first compressor 21 only.

[2] Partial Load Operation (First and Second Compressors Running)

Figure 4:
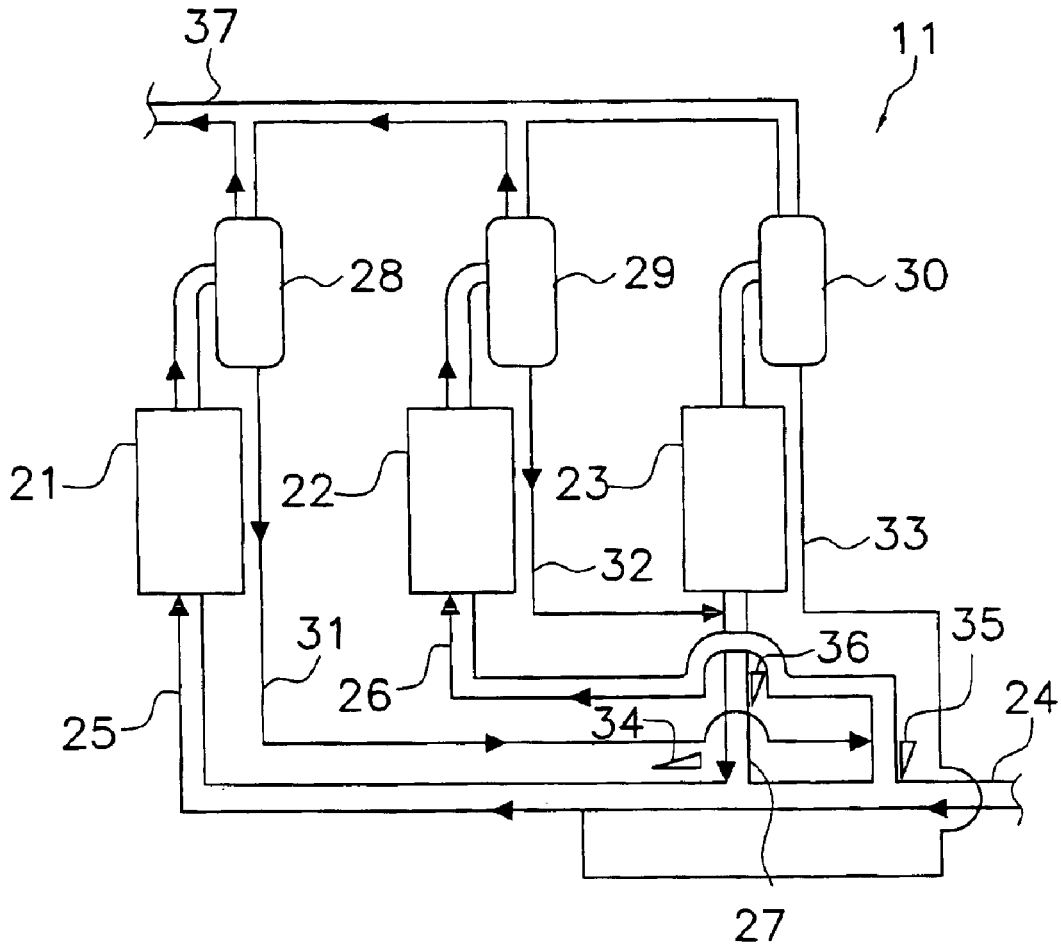
FIG. 4 illustrates the operation of a compression mechanism in accordance with the first embodiment.

If, after the first compressor 21 is started, the second compressor 22 is started in order to increase the operating load, then, as shown in FIG. 4 (the flow of refrigerant and oil is indicated in FIG. 4 with arrows), a portion of the gaseous refrigerant flowing through the refrigerant intake main pipe 24 passes through the second intake branch pipe 26 and into the second compressor 22. The oil that flows into the second intake branch pipe 26 from the first oil return pipe 31 is drawn into the second compressor 22 along with the gaseous refrigerant flowing through the second intake branch pipe 26. Similarly to the gaseous refrigerant drawn into the first compressor 21, the gaseous refrigerant drawn into the second compressor 22 is then compressed and discharged, after which it flows into the second oil separator 29 where the gaseous refrigerant and oil are separated by vapor-liquid separation. Then, the gaseous refrigerant passes through the refrigerant pipe at the outlet of the second oil separator 29, flows into the discharge merge pipe 37, and circulates through the refrigerant circuit shown in FIG. 1.

Meanwhile, the oil separated in the second oil separator 29 leaves the oil outlet of the second oil separator 29, passes through the second oil return pipe 32 and flows into the third intake branch pipe 27. Similarly to the second intake branch pipe 26, the third intake branch pipe 27 is arranged so as to slope downward from the part where it connects to the second oil return pipe 32 toward the part where it connects to the refrigerant intake main pipe 24 (see the wedge symbol 36). As a result, the oil that flows into the third intake branch pipe 27 from the second oil return pipe 32 is delivered to the refrigerant intake main pipe 24 due to the action of gravity. The third intake branch pipe 27 connects to the refrigerant intake main pipe at a position closer to the first intake branch pipe 25 than the second intake branch pipe 26 does, i.e., at a position further downstream relative to the flow of the gaseous refrigerant. Consequently, the oil that flows into the refrigerant intake main pipe 24 from the third intake branch pipe 27 is drawn into the first compressor 21 again along with the gaseous refrigerant flowing through the refrigerant intake main pipe 24 and does not flow into the second compressor 22. In this way, an oil supply circuit is formed in which oil is supplied in turn to the first compressor and second compressors 21, 22 only.

[3] Full Load Operation (First, Second, and Third Compressors Running)

Figure 5:
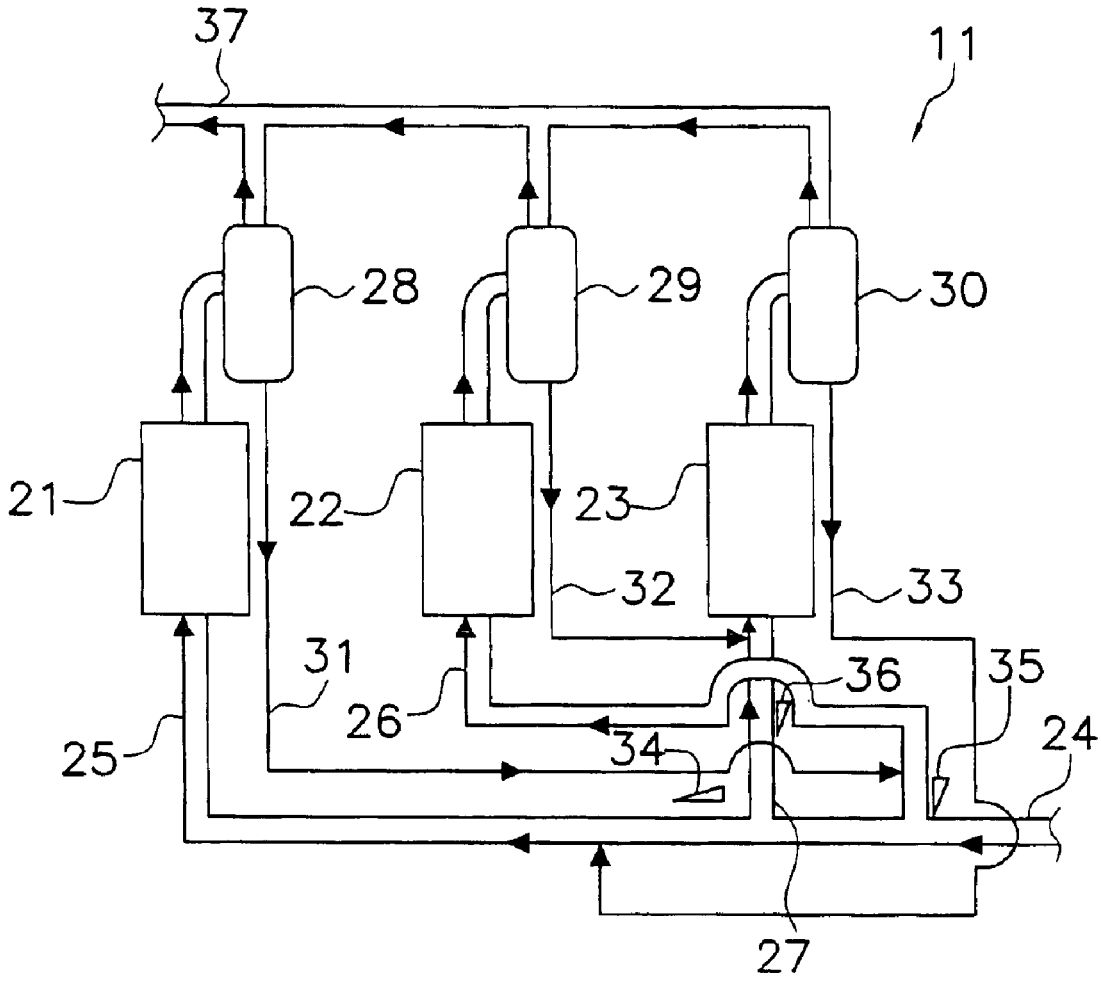
FIG. 5 illustrates the operation of a compression mechanism in accordance with the first embodiment.

If, after the second compressor 22 is started, the third compressor 23 is started in order to achieve full-load operation, then, as shown in FIG. 5 (the flow of refrigerant and oil is indicated in FIG. 5 with arrows), a portion of the gaseous refrigerant flowing through the refrigerant intake main pipe 24 passes through the third intake branch pipe 27 and into the third compressor 23. The oil that flows into the third intake branch pipe 27 from the second oil return pipe 32 is drawn into the third compressor 23 along with the gaseous refrigerant flowing through the third intake branch pipe 27. Similarly to the gaseous refrigerant drawn into the first and second compressors 21 and 22, the gaseous refrigerant drawn into the third compressor 23 is compressed and discharged, after which is separated from the oil by vapor-liquid separation in the third oil separator 30. Then, the gaseous refrigerant passes through the refrigerant pipe at the outlet of the third oil separator 30, flows into the discharge merge pipe 37, and circulates through the refrigerant circuit shown in FIG. 1.

Meanwhile, the oil separated in the third oil separator 30 leaves the oil outlet of the third oil separator 30, passes through the third oil return pipe 33, and flows into refrigerant intake main pipe 24 at a position between where the first intake branch pipe 25 connects and where the third intake branch pipe 27 connects. In this way, an oil supply circuit is formed in which oil is supplied in turn to all of the compressors, i.e., the first, second, and third compressors 21, 22, 23.

(3) Characteristic Features of the Compression Mechanism

The compression mechanism 11 of this embodiment has the following characteristic features.

[1] Oil Supply Circuit can Supply Oil Reliably During Partial Load Operation

In the compression mechanism 11 of this embodiment, the oil flow is configured such that when the first, second, and third compressors are all running, the oil discharged with the gaseous refrigerant from the first compressor 21 is separated by the first oil separator 28 and delivered to the second compressor 22 through the first oil return pipe 31, the oil discharged from the second compressor 22 is delivered to the third compressor 23 through the second oil return pipe 32, and the oil discharged from the third compressor 23 is delivered to the first compressor 21 through the third oil return pipe 33. Thus, the compression mechanism 11 forms a circulation cycle in which the oil passes through each compressor 21, 22, 23 in turn and is reliably delivered to the compressors that are running, i.e., the first, second, and third compressors 21, 22, 23.

Furthermore, the oil flow this compression mechanism 11 is configured such that when the first compressor 21 is running and the second and third compressors 22, 23 are not running, the oil delivered from the first oil return pipe 31 to the intake side of the second compressor 22 is delivered to the refrigerant intake main pipe 24 by gravity and drawn together with gaseous refrigerant into the first compressor 21 through the first intake branch pipe 25, which is connected farther downstream than the second compressor 22. As a result, oil is reliably delivered to the compressor that is running, i.e., the first compressor 21.

Moreover, the oil flow of this compression mechanism 11 is configured such that when the first and second compressors 21, 22 are running and the third compressor 23 is not running, the oil delivered from the second oil return pipe 32 to the intake side of the third compressor 23 is delivered to the refrigerant intake main pipe 24 by gravity and drawn together with gaseous refrigerant into the first compressor 21 through the first intake branch pipe 25, which is connected farther downstream than the third compressor 23. Since the second compressor 22 is connected to the refrigerant intake main pipe 24 at a more upstream position than the third compressor 23, an oil circulation cycle is achieved in which the oil returned through the second oil return pipe 32 is not drawn again into the second compressor 22 but rather passes through each of the compressors 21, 22 in turn in the same manner as when the first, second, and third compressors 21, 22, 23 are all running. As a result, oil is reliably delivered to the compressors that are running, i.e., the first and second compressors 21, 22.

Thus, with this compression mechanism 11, oil can be delivered reliably to the compressors that are running even when the system is operated in partial load mode with only the first compressor 21 running or only the first and second compressors 21, 22 running. Additionally, the circuit structure is simple because there are no oil equalizing pipes like those found in conventional compression mechanisms.

[2] Oil is Returned to Refrigerant Intake Main Pipe from Intake Branch Pipe of Stopped Compressors In the compression mechanism 11 of this embodiment, a structure for using gravity to send oil to the refrigerant intake main pipe 24 from the first and second oil return pipes 31, 32 is obtained by making the second and third intake branch pipes 26, 27 slope downward from the parts where they connect to the first and second oil return pipes 31, 32 toward the parts where they connect to the refrigerant intake main pipe 24. As a result, the structure of the circuit from the refrigerant intake main pipe 24 to the intake sides of the compressors 22. 23 is not complex.

[3] Oil Flows Readily from the Refrigerant Intake Main Pipe Toward the First Intake Ranch Pipe With the compression mechanism 11 of this embodiment, the oil is reliably drawn into the first compressor 21 because the refrigerant intake main pipe 24 slants toward the first intake branch pipe 25 and the oil delivered to the refrigerant intake main pipe 24 from the second and third intake branch pipes 26, 27 flows readily toward the part where the refrigerant intake main pipe 24 connects to the first intake branch pipe 25. Thus, the reliability of the oil supply to the compressors is improved.

[Second Embodiment]

While the first embodiment regards a compression mechanism 11 provided with three compressors, this embodiment regards a compression mechanism provided with multiple, i.e., more than three, compressors. A compression mechanisms provide with "multiple compressors" might have, for example, four or six compressors, but this embodiment describes a generalized configuration having n compressors, i.e., first to nth compressors (where n is any integer equal to or greater than 3).

Figure 6:
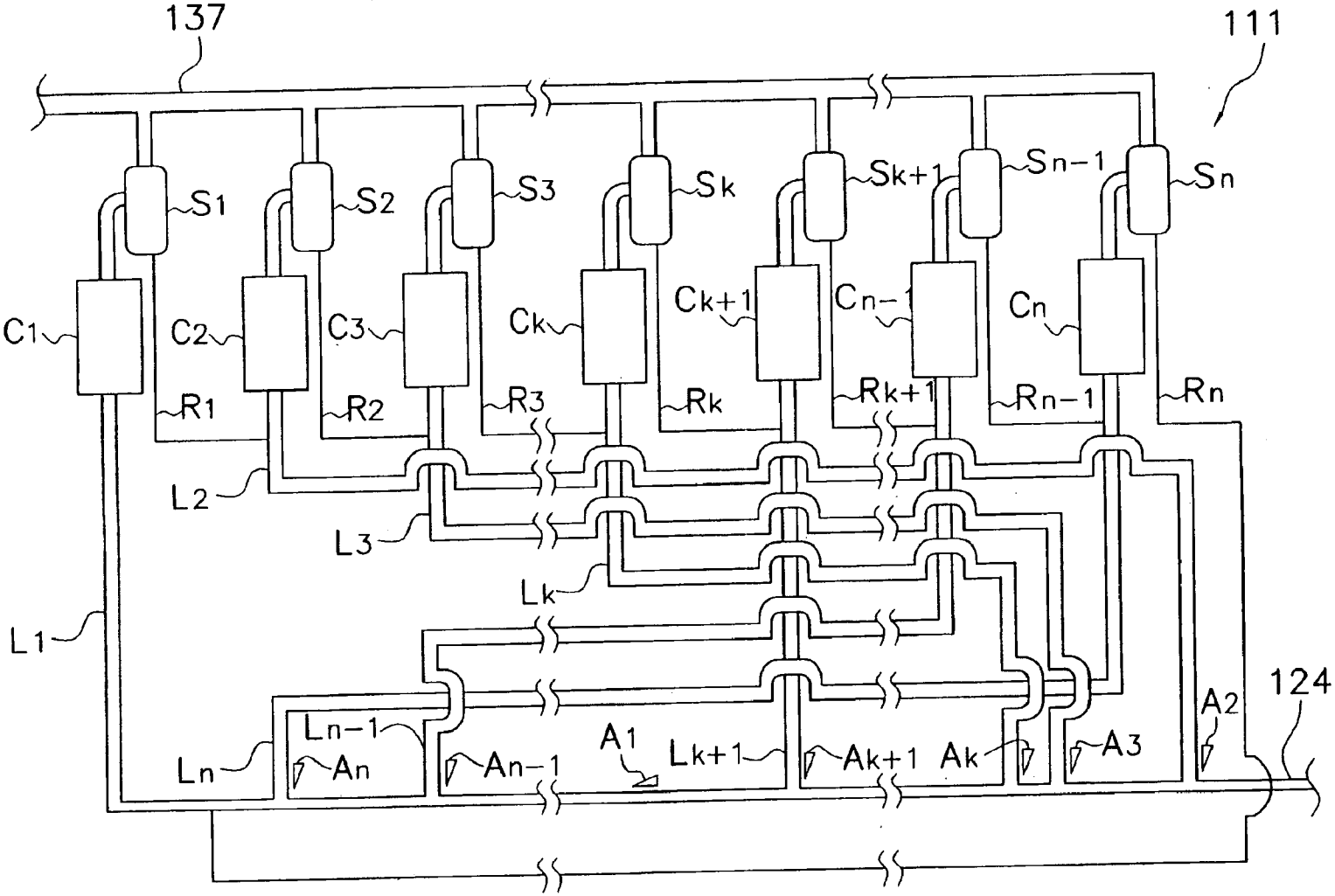
FIG. 6 shows a compression mechanism in accordance with a second embodiment and is equivalent to FIG. 2.

FIG. 6 illustrates a compression mechanism 111 provided with n compressors, i.e., first to nth compressors. The compression mechanism 111 is provided with n (first to nth) compressors C1 to Cn, a refrigerant intake main pipe 124, n intake branch pipes L1 to Ln, n oil separators S1 to Sn, and n oil return pipes R1 to Rn. The refrigerant pipes at the outlets of the n oil separators S1 to Sn each merge with the discharge merge pipe 137. The refrigerant intake main pipe 124 and the discharge merge pipe 137 are connected to a refrigerant circuit similar to that of the first embodiment.

Among the n intake branch pipes L1 to Ln, the second to nth intake branch pipes L2 to Ln branch in sequence from the upstream side of the refrigerant intake main pipe 124 and are connected in such a manner as to correspond to the intake sides of the second to nth compressors C2 to Cn, respectively. Meanwhile, the first intake branch pipe L1 branches from the refrigerant intake main pipe 124 at a position downstream of the nth intake branch pipe Ln and connects to the intake side of the first compressor C I. Similarly to the first embodiment, the refrigerant intake main pipe 124 is arranged such that it slopes downward from the parts where it connects to the second to nth intake branch pipes L2 to Ln toward the part where it connects to the first intake branch pipe L1 (see the wedge symbol A1 in FIG. 6).

The n separators, i.e., first to nth separators S1 to Sn, are connected to the discharge sides of the respective first to nth compressors in order to separate the oil from the gaseous refrigerant compressed by the first to nth compressors C1 to Cn.

The n oil return pipes R1 to Rn are arranged such that the first to n−1 oil return pipes R1 to Rn−1 are connected between the oil outlets of the first to n−1 oil separators S1 to Sn−1 and the intake sides of the respective second to nth compressors C2 to Cn and the nth oil return pipe Rn is connected between the nth oil separator Sn and the intake side of the first compressor C1. More specifically, the first to n−1 oil return pipes R1 to Rn−1 are connected to the second to nth intake branch pipes L2 to Ln, respectively, and the nth oil return pipe Rn is connected to the refrigerant intake main pipe 124 at a position downstream of the n−1 intake branch pipe Ln−1.

The first to kth oil return pipes R1 to Rk (where k is integers from 2 to n−1) are connected to the intake side of the k+1 compressor Ck+1 so that oil is delivered to the refrigerant intake main pipe 124 by gravity when the first to k compressors C1 to Ck are running and the k+1 to nth compressors Ck+1 to Cn are stopped. More specifically, the second to nth intake branch pipes L2 to Ln are arranged such that they slope downward from the parts where they connect to the first to n−1 oil return pipes R1 to Rn−1, respectively, toward the parts where they connect to the refrigerant intake main pipe 124 (see the wedge symbols A2 to An in FIG. 6).

In the compression mechanism 111 of this embodiment, similarly to the compression mechanism 11 of the first embodiment, the oil flow is configured such that when the first to nth compressors C1 to Cn are all running, the oil discharged with the gaseous refrigerant from the first compressor C1 is separated by the first oil separator S1 and delivered to the second compressor C2 through the first oil return pipe R1, the oil discharged from the second compressor C2 is delivered to the third compressor C3 through the second oil return pipe R2, and so on in sequence to the nth compressor Cn. The oil discharged from the nth compressor Cn is delivered to the first compressor C1 through the nth oil return pipe Rn. Thus, this compression mechanism 11 forms a circulation cycle in which the oil passes through each compressor C1 to Cn in turn and is reliably delivered to all of the compressors that are running, i.e., the first to nth compressors C1 to Cn.

Furthermore, the oil flow of the compression mechanism 111 of this embodiment is configured such that when the first to kth compressors C1 to Ck are running and the k+1 to nth compressors Ck+1 to Cn are not running, the oil delivered from the kth oil return pipe Rk to the intake side of the k+1 compressor Ck+1 is fed to the refrigerant intake main pipe 124 due to gravity and drawn together with gaseous refrigerant into the first compressor C1 through the first intake branch pipe L1, which is connected farther downstream than the k+1 compressor Ck+1. Since the kth compressor Ck is connected to the refrigerant intake main pipe 124 at a more upstream position than the k+1 compressor Ck+1, an oil circulation cycle is achieved in which the oil returned through the kth oil return pipe Rk is not drawn again into the second to kth compressors C2 to Ck (i.e., running compressors other than the first compressor C1) but rather passes through each of the running compressors C1 to Ck in turn in the same manner as when all of the first to nth compressors C1 to Cn are running. As a result, oil is reliably delivered to the compressors that are running, i.e., the first to kth compressors C1 to Ck.

Thus, similarly to the first embodiment, oil can be delivered reliably to the compressors that are running when the system is operated in partial load mode, even in a compression mechanism 11 having multiple (i.e., more than three) compressors. As a result, it is possible to provide a large-capacity heat source unit that is provided with multiple (i.e., more than three) compressors and capable of partial load operation.

[Other Embodiments]

Although embodiments of the present invention have been described herein with reference to the drawings, the specific constituent features are not limited to those of these embodiments and variations can be made within a scope that does not deviate from the gist of the invention.

For example, although in the first embodiment the third oil return pipe 33 connects to the refrigerant intake main pipe 24 at a position downstream of the second intake branch pipe 26, it is also acceptable for the same oil return pipe to connect to the first intake branch pipe 25. Similarly, although in the second embodiment the nth oil return pipe Rn connects to the refrigerant intake main pipe 124 at a position downstream of the second intake branch pipe L2, it is also acceptable for the same oil return pipe to connect to the first intake branch pipe L1.

APPLICABILITY TO INDUSTRY

Use of the present invention makes it possible to deliver oil reliably to the compressors that are running in a compression mechanism provided with a plurality of compressors, even when the system is operated in a partial load mode.

What is claimed is:

1. A compression mechanism forming a refrigerant circuit of a vapor compression refrigeration system, comprising:

a refrigerant intake main pipe;

n compressors with n being any integer equal to or greater than 3, which are arranged such that the second to $n^{th}$ compressors are connected to the refrigerant intake main pipe in sequence from an upstream side of a flow of gaseous refrigerant and the first compressor is connected downstream of the $n^{th}$ compressor;

n oil separators with the first to $n^{th}$ oil separators connected to discharge sides of the respective first to $n^{th}$ compressors in order to separate oil from the gaseous refrigerant compressed by the first to $n^{th}$ compressors; and n oil return pipes arranged such that the first to n−1 oil return pipes are connected between oil outlets of the first to n−1 oil separators and intake sides of the respective second to $n^{th}$ compressors and the $n^{th}$ oil return pipe is connected between the $n^{th}$ oil separator and an intake side of the first compressor, the first to k oil return pipes with k being integers from 2 to n−1 are connected to the intake side of the k+1 compressor so that oil is delivered to the first compressor when the first to k compressors are running and the k+1 to n compressors are stopped.

2. The compression mechanism recited in claim 1, further comprising n intake branch pipes with the first to $n^{th}$ intake branch pipes branching from the refrigerant intake main pipe in such a manner as to correspond to the intake sides of the first to $n^{th}$ compressors, respectively, the first to n−1 oil return pipes being connected to the second to $n^{th}$ intake branch pipes, respectively, and the second to $n^{th}$ intake branch pipes being arranged so as to slope downward from parts where they connect to the first to n−1 oil return pipes, respectively, toward parts where they connect to the refrigerant intake main pipe.

3. The compression mechanism recited in claim 2, wherein the refrigerant intake main pipe is arranged such that it slopes downward from the parts where it connects to the second to $n^{th}$ intake branch pipes toward the part where it connects to the first intake branch pipe.

4. A compression mechanism forming a refrigerant circuit of a vapor compression refrigeration system, comprising:

a refrigerant intake main pipe;

first, second and third compressors with the second and third compressors being connected to the refrigerant intake main pipe in sequence from an upstream side of a flow of intake gaseous refrigerant and the first compressor being connected downstream of the third compressor;

first, second, and third oil separators connected to discharge sides of the first, second, and third compressors, respectively, in order to separate oil from the gaseous refrigerant compressed by the first, second, and third compressors; and first and second oil return pipes connected between oil outlets of the first and second oil separators and intake sides of the respective second and third compressors and a third oil return pipe connected between the third oil separator and an intake side of the first compressor, the first oil return pipe being connected to the intake side of the second compressor such that oil is delivered to the refrigerant intake main pipe when the first compressor is running and the second and third compressors are stopped, the second oil return pipe being connected to the intake side of the third compressor such that oil is delivered to the refrigerant intake main pipe when the first and second compressors are running and the third compressor is stopped.

* * * * *